United States Patent [19]

Reed

[11] 4,174,943

[45] Nov. 20, 1979

[54] FUEL GAS PREHEAT FOR EXCESS OXYGEN MAINTENANCE

[75] Inventor: Robert D. Reed, Tulsa, Okla.

[73] Assignee: John Zink Company, Tulsa, Okla.

[21] Appl. No.: 847,227

[22] Filed: Oct. 31, 1977

[51] Int. Cl.[2] ..... F23N 5/18

[52] U.S. Cl. ..... 431/41; 431/76

[58] Field of Search ..... 431/11, 13, 41, 76, 431/90

[56] References Cited

U.S. PATENT DOCUMENTS

| | | | |
|---|---|---|---|
| 1,562,910 | 11/1925 | Hock | 431/41 |
| 3,503,553 | 3/1970 | Schomaker | 431/76 |
| 3,561,895 | 2/1971 | Michelson | 431/11 |

*Primary Examiner*—Carroll B. Dority, Jr.
*Attorney, Agent, or Firm*—Head, Johnson & Chafin

[57] ABSTRACT

A system of preheating of gaseous fuels to a furnace in which the fuels have a wide range of molecular weights, and corresponding calorific values, and in which all of the combustion air is provided by inspiration, due to the flow energy of the fuel. The invention involves the monitoring of oxygen in the products of combustion moving from the furnace to the stack, or, alternatively, monitoring the molecular weight of the fuel on the inlet line, and controlling the preheating of the fuel in a heat exchanger, so as to maintain a selected temperature of the fuel going to the burners, in accordance with the molecular weight of the fuel.

2 Claims, 3 Drawing Figures

FUEL GAS PREHEAT FOR EXCESS OXYGEN MAINTENANCE

BACKGROUND OF THE INVENTION

1. FIELD OF THE INVENTION

This invention lies in the field of the burning of gaseous fuels in furnaces and the like. More particularly, it concerns the burning of gaseous fuels, where the fuels have a wide range of molecular weight, and corresponding calorific value, and wherein the full amount of combustion air is inspirated by the kinetic energy of the fuel flowing to the burner.

2. DESCRIPTION OF THE PRIOR ART

In the prior art it has been customary to build a furnace burner system which is designed substantially entirely on the basis of the use of a single fuel. Thus, given the single fuel, namely one which has a preselected molecular weight and calorific value, the burner system is designed so that the applied pressure of the fuel, size of orifices, etc., are such as to inspirate the full amount of combustion air, required to maintain a minimum value of excess oxygen in the products of combustion as they flow to the stack.

Those who are versed in the art of design and operation of fuel gas burners consider it axiomatic that there is very little room for error in either the design or operation of fuel gas burners which inspirate 100% of their air requirement for theoretical air, plus an optimum excess air factor which is typically indicated by from 1% to 2% oxygen in the combustion gases directly enroute to a stack or chimney for venting to atmosphere after suitable heat extraction from them.

Burner design must be very closely controlled, but those skilled in the art of burner design, who have established practices for such control, find little difficulty. Thus, this factor is under control. But an unescapable factor as relates to burner operation is that such burners are severely limited for acceptance of varying gas fuels, where there is increase in fuel calorific value and fuel molecular weight. An upper limit for calorific value increase without upset, is in the order of 5% as relates to BTU/cubic feet.

This limitation prevents the use of a number of available fuel supplies, and necessitates the use of a fixed gaseous fuel supply (which is natural gas in a preponderance of cases) to seriously interfere with fuel heat energy conservation in areas where the conservation is most needed.

Reasons for this are complex, but they do require understanding. Burner air inspiration results from use of the energy made available as the gas fuel is discharged from supply pressure (which is generally as much as 15 gauge) at critical or sonic velocity, from an orifice. The orifice discharges gas fuel coaxially into an aspirator throat. Air is drawn into and mixed with gas so the discharge from the aspirator throat, at its down stream end, is a burnable gas-air mixture with a selected quantity of excess air for the gas fuel. Oxygen at 1% in the combustion effluent gases indicates substantially 5% excess air, and Oxygen at 2% is substantially 10% excess air. Efficiency of fuel-supplied heat usage is maximum at lowest air. $O_2$ is an accurate indicator of excess air (rather than $CO_2$), and for that reason, in any case of fuel burning, it is preferable to monitor the $O_2$ content of the effluent combustion gases as nearly constantly as possible because, in any case of fuel burning for production of useful heat, the efficiency of heat utilization is according to the excess air present as the fuel burns. Higher excess air denotes fuel wastage, and lower excess air denotes fuel conservation.

It is axiomatic among well-informed operating people to accept 1% $O_2$–5% excess air as an absolute minimum, and 2% $O_2$–10% excess air as a preferred maximum figure which, while it is optimum, should be checked (monitored) as nearly constantly as possible. Such monitoring is increasingly present in industry, but far from universally present. The use of 100% inspirating burners is typically (but not necessarily) limited to highly pyrophoric processes such as ammonia synthesis or hydrocarbon 'cracking' for preferred olefins production because of the precise process control they provide when suitably controlled, and supplied with suitable gaseous fuels.

But the stringent limitation which applies to 'suitable fuels' has, in prior practice, demanded the use of fixed fuels rather than a variety of fuels, such as are typically found in process facilities to, at times, result in fuel wastage. As has been previously noted, increase of 5% for fuel calorific value per cubic foot has, heretofore, been a limiting factor in fuels usage.

This invention, in differentiation from the prior art, allows the use of fuels in which the molecular weight and calorific value may increase by as much as 100%, while maintaining a very stable operation, with the same burner structures which formerly were intolerant of more than a 5% increase in molecular weight or calorific value.

All fuel gas burners are not designed for supply of all their air for combustion through gas-inspiration of air, as primary air or air premixed with the gas fuel. They rely on additional air supply for make-up of total air for combustion demand. The second (secondary air) supply of air may be due to furnace draft or other means for air supply to furnaces, and is controlled as to quantity by any of well-known devices common to the art of burning fuels. But there is always a fixed ratio of primary to secondary air volume (quantity) for supply of total air demand, if optimum (best) fuel conservation is to be observed, and stack gas $O_2$ remains constant.

The secondary air volume is firmly fixed by the secondary air supply means and control, but the inspirated primary air volume is according to gas-supplied discharge energy, as is the case with 100% inspirating burners. Thus, and as the calorific value (molecular weight) of the gaseous fuel changes, the volume of inspirated primary air changes to destroy the primary-secondary air ratio, which will be productive of a preferred $O_2$ concentration in the effluent combustion gases.

This ratio must be maintained for greatest fuel conservation. For this reason, preheat of the gaseous fuel to a selected temprature can maintain gaseous fuel energy for air inspiration, as per the table on Page 9, for burners which aspirate all combustion air, and also to maintain the ratio of primary to secondary air, which is productive of a preferred $O_2$ content in the effluent combustion gases, in burners which require both primary and secondary air for their burning of fuels.

SUMMARY OF THE INVENTION

It is a primary object of this invention to provide a furnace burner system which is adapted to aspirate all of the combustion air requirements, while utilizing fuels which vary as much as 100% in molecular weight or calorific value, without adjustment of the burner system.

It is a further object of this invention to provide means for heating the hydrocarbon fuel to a selected temperature, as a function of a molecular weight of the fuel, whereby the heavier fuels which are heated to higher temperature will continue to provide the full combustion air requiements when supplied at the same pressure, as for lighter molecular weight gaseous fuels.

In gaseous fuels, as the heating value per cubic foot rises, its molecular weight rises. Rise in heating value requires less fuel gas volume, and rise in molecular weight causes fewer SCF to flow across (through) an orifice at the same pressure drop if the temperature of the gas fuel is unchanged, but each is far from correction for the other. As the heating value per cubic foot rises there is less energy resulting from gas discharge from the aspirator orifice and less air is inspirated and air deficiency exists to result in incomplete burning of the gas fuel.

But, if the temperature of the gas fuel can be suitably increased under control as the gas heating value/-molecular weight increases, the energy for inspiration of air can be held substantially constant for any increase in the heating value/molecular weight such as might occur.

As an essential corollary relating to increased energy for air inspiration in greater quantity as required, if the $O_2$ rises beyond a preferred concentration in the effluent combustion gases to indicate too great an excess air factor, and less than preferred thermal efficiency, decrease in gas temperature lessens gas inspirational energy for reduced air inspiration (less excess air) back to a lower and preferred $O_2$ concentration in the effluent combustion gases. This is to say that gas fuel temperature control is a useful, and previously unobvious means for optimum control of excess air ($O_2$ in effluent combustion gases) when burners designed for 100% air inspiration are in use. Fuel gas temperatures control has the additional advantage of requiring substantially constant fuel gas supply pressure to the burners regardless of increase in heating value and/or molecular weight of the gas fuel.

Methane (natural gas) is a standard gas fuel for burners which are designed for 100% air inspiration. Its calorific value is 910 btu/cubic foot and its molecular weight is 16. If the standard temperature of 60 F. (520 absolute) is presumed for methane, the following tabulation will be informative:

ALL BASED ON HEAT RELEASE OF 1MM/BTU/HR

| Fuel Gas | Molecular Weight | Fuel Pressure | Energy for Air Insp | Fuel Temperature |
|---|---|---|---|---|
| 910 btu/cf | 16 | 15# | 546 FT#/SEC | 60F |
| 981 btu/cf | 17.4 | 15.2# | 548 FT#/SEC | 105F |
| 1058 btu/cf | 18.8 | 15.2# | 547 FT#/SEC | 150F |
| 1123 btu/cf | 20.2 | 15.8# | 549 FT#/SEC | 200F |
| 1194 btu/cf | 21.6 | 15.8# | 544 FT#/SEC | 240F |
| 1265 btu/cf | 23.0 | 16.0# | 545 FT#/SEC | 290F |

It is to be seen from the tabulation that, if the energy for air inspiration is kept substantially constant, the air aspirated remains equally substantially constant, and regardless of fuel, a fixed air quantity will enable release of a preferred quantity of heat, within very narrow limits, from light methane to very heavy fuel oil. If not enough air is being aspirated, a rise in gas fuel temperature will increase air aspiration, and if too much air is being aspirated, a temperature decrease for the fuel will provide correction. It is thus possible to maintain a preferred excess air ($O_2$) condition when burners for 100% air aspiration are in service, just by control of fuel gas temperature.

These and other objects are realized and the limitations of the prior art are overcome in this invention by providing a heat exchanger, or other means, for preheating the fuel gas. While any method of preheating the fuel gas is satisfactory, it is most convenient to use, and the most easily controlled, to use steam as the heat supply medium, and to control the rate of flow of steam to the heat exchanger in order to maintain a selected temperature of the fuel.

Two methods are provided for sensing an out-of-balance system in the furnace, one is to monitor the oxygen percentage in the products of combustion from the furnace, and, responsive to the precentage of oxygen, to control the flow of steam in order to change the fuel temperature. As the excess oxygen is reduced below a normal minimum, the flow of steam is increased, so as to increase the temperature of the fuel, and thus maintain a constant flow of combustion air, so as to provide a satisfactory minimum value of excess oxygen.

If desired, a display of the oxygen content can be made, and the control of steam may be by manual means.

Another method of control is to provide a sensor to measure the molecular weight of the fuel, and responsive to the molecular weight to automatically control the flow of steam to the heat exchanger, and thus change the temperature of the fuel gas.

BRIEF DESCRIPTION OF THE DRAWINGS

These and other objects and advantages of this invention and a better understanding of the principles of the invention will be evident from the following description taken in conjunction with the appended drawings in which.

DESCRIPTION OF THE PREFERRED EMBODIMENT

Figure 1:
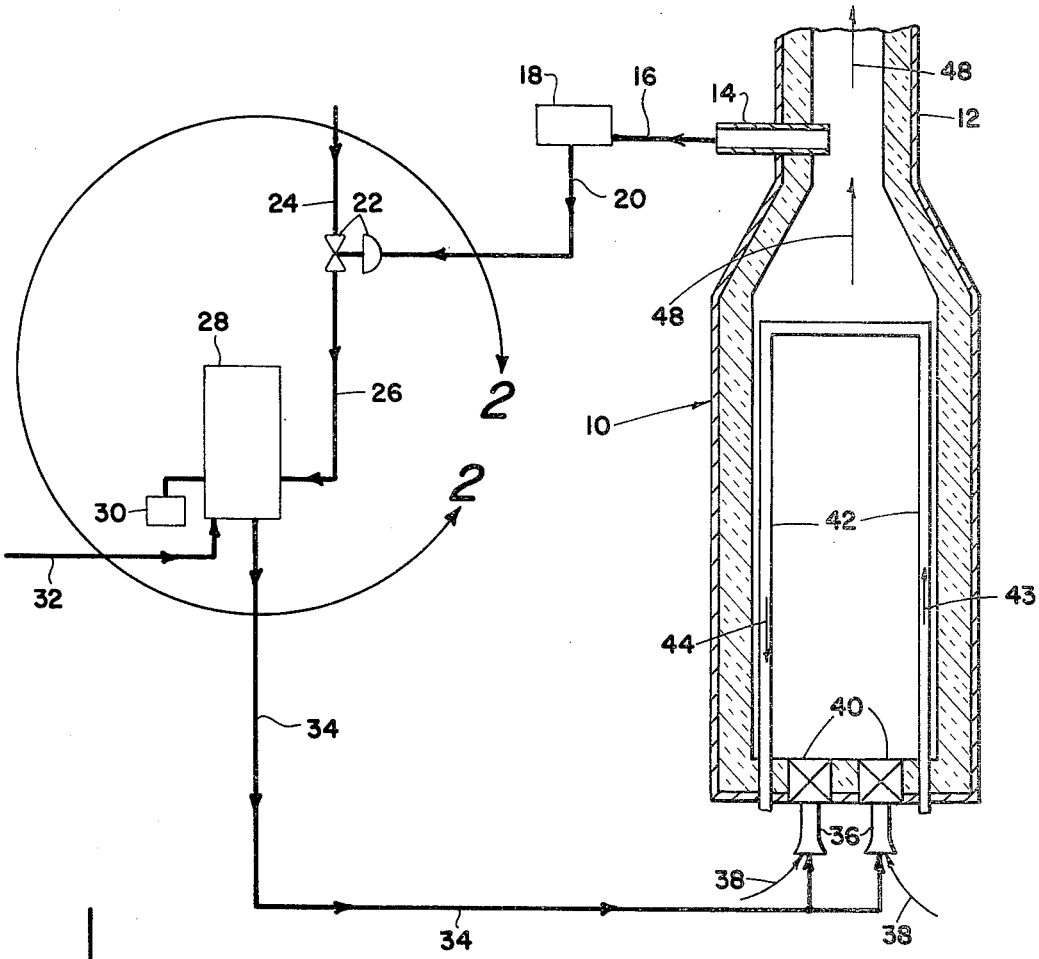
FIG. 1 illustrates one embodiment of this invention.

Referring now to the drawings and, in particular to FIG. 1, there is shown a furnace structure 10 providing a furnace 42 for the purpose of heating a fluid, as in pipes 43 and 44, for example, or for other uses such as in chemical processing. Raw fuel gas is supplied over line 32 to a heat exchanger 28 to which steam is supplied by means of line 26, in variable amount, according to the control valve 22 connected to the supply 24 of steam. Means 30 are provided for collecting the condensate, etc., as is well known in the art, The entering fuel gas on line 32 is now heated to a selected temperature, and goes by way of line 34 to the air inductors 36 which supply primary combustion air 38.

In the outlet of the furnace at the base of the stack 12 is positioned a sensor 14 for measuring the percentage of oxygen in the effluent gases. The sensor signal goes by line 16 to an indicator, recorder, or controller, such as 18.

A signal from the controller 18 goes by lead 20 to a control valve 22, which controls the steam supply 24, and provides a selected flow rate of steam on line 26 to the heat exchanger 28.

Consider that methane, or natural gas, is the fuel supplied on the line 32, which goes through the preheater and by line 34 to the burners 36, where the burner design is such as to provide at least 100%, or slightly greater, of normal air requirements for the fuel. The amount of air varies in proportion to the amount of fuel, as heat requirements increase or decrease. But the aspirated air is always in the range of 100% to 105% of the requirements for the fuel burned.

If the sensor detects less than a minimum of, say 1%, oxygen, which corresponds to approximately 5% excess air, it will call for more steam through the control valve 22, and thus provide a higher temperature of the outlet fuel 34, so that the amount of aspirated air will increase, so as to maintain a safe quantity of excess air. This will avoid combustion with less than the proper air requirement, and thus avoid incomplete combustion, and lowered efficiency, and presence of carbon monoxide, etc. On the other hand, if the percentage of oxygen measured by the sensor 14 increases, the steam supply will be reduced and the temperature of the fuel gas will be reduced, so as to reduce the aspirated air to maintain a desired proportion of excess air.

Figure 2:
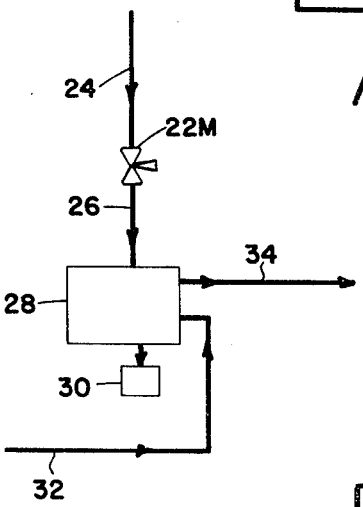
FIG. 2 illustrates a modification of a portion 2—2 of FIG. 1.

By reference to FIG. 2 there is shown a modification of the system of FIG. 1, wherein the line 20 from the controller 18 is broken and a manual control valve 22 M is provided. In other words, the display controller 18 will display a measure of the oxygen percentage, and responsive to the displayed value, an operator will then control the steam flow, etc.

Normal design capability with regard to burners which utilize a single fuel is such that there is little need for the type of control indicated in FIG. 1 so long as the fuel remains a standard fuel for which the burner was designed. In the use of various types of gaseous fuels, of different molecular weight, it becomes important to provide control on the fuel temperature, in order to maintain a satisfactory balance in the excess air in the furnace effluent.

Figure 3:
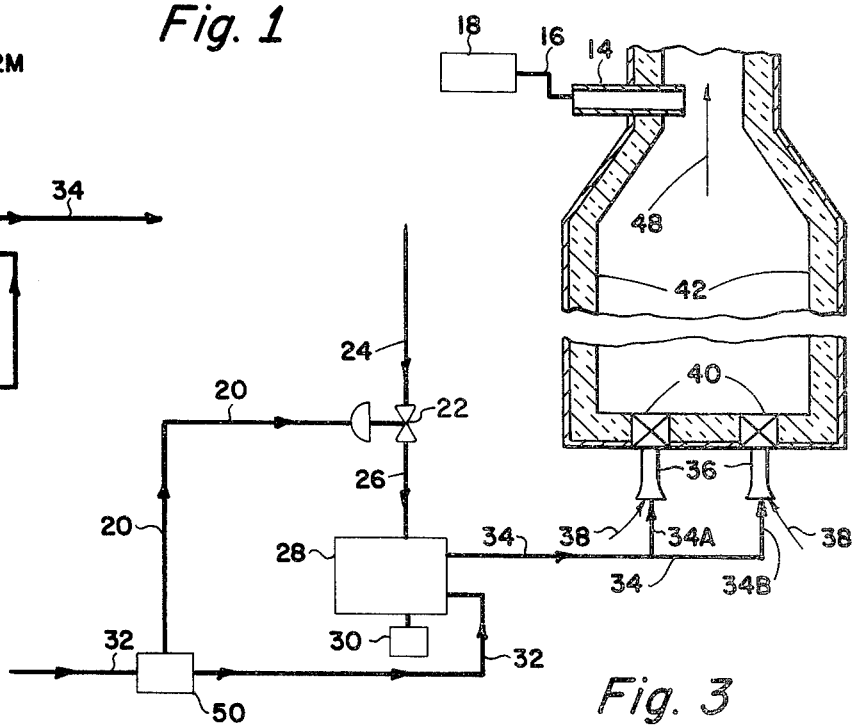
FIG. 3 illustrates a second embodiment of this invention.

Referring now to FIG. 3, there is shown a second embodiment of this invention in which the control of the valve 22 that supplies steam to preheat the fuel gas is responsive to a sensor 50 which measures the molecular weight of the fuel gas. As the molecular weight increases above that of the design fuel gas, say methane, the valve 22 is opened to provide more preheating of the fuel gas in order to maintain the proper aspiration of air for combustion.

The system is similar to that of FIG. 1 except that the control is from a sensor 50, which can be a conventional device for measuring the molecularweight of gas, and a controller, as part of 50, then will send a signal along line 20 to the control valve 22 so as to control the flow of steam upwardly, whenever the molecular weight increases and vice versa.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claims, including the full range of equivalency to which each element or step thereof is entitled.

What is claimed is

1. In a furnace for combustion of gaseous fuels, said furnace having an outlet stack for the products of such combustion, said fuels having a wide range of molecular weights and calorific values, and including burner means in which a selected percentage of all of the combustion air is provided by inspiration, due to the flow energy of the fuel; the improvement in apparatus for providing full combustion air requirements, comprising;

means to preheat said fuel so as to vary the temperature of said fuel in relation to the molecular weight and calorific value of said fuel; and means to monitor the percentage of excess oxygen in the products of combustion of said fuel on the way to the stack; and means responsive to said means to monitor, to control the heating of said fuel;

whereby, as the percentage of oxygen increases, the temperature of heating of said gaseous fuel decreases, and vice versa.

2. The apparatus as in claim 1 in which said responsive means includes means to display said amount of oxygen.

* * * * *